US007540786B1

(12) United States Patent
Koser et al.

(10) Patent No.: US 7,540,786 B1
(45) Date of Patent: Jun. 2, 2009

(54) FLASH MEMORY DEVICE WITH IMPROVED CONTACT ARRANGEMENT

(75) Inventors: James Koser, Elizabethtown, PA (US); Chong Yi, Mechanicsburg, PA (US); Kuan-Yu Chen, Harrisburg, PA (US); Kevin E. Walker, Hershey, PA (US); Gary E. Biddle, Carlisle, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/148,277

(22) Filed: Apr. 17, 2008

(51) Int. Cl.
*H01R 24/00* (2006.01)

(52) U.S. Cl. ..... 439/660

(58) Field of Classification Search ..... 439/607, 439/356–358, 76.1, 660, 620.1
See application file for complete search history.

(56) References Cited

U.S. PATENT DOCUMENTS

| | | | | |
|---|---|---|---|---|
| 6,276,943 | B1 * | 8/2001 | Boutros et al. | 439/76.1 |
| 6,948,965 | B2 * | 9/2005 | Kumamoto et al. | 439/358 |
| 6,994,568 | B2 | 2/2006 | Huang et al. | |
| 7,128,608 | B1 * | 10/2006 | Chen | 439/607 |
| 7,186,147 | B1 | 3/2007 | Chou et al. | |
| 7,232,346 | B2 * | 6/2007 | Hu et al. | 439/660 |
| 7,252,518 | B1 * | 8/2007 | Ni | 439/76.1 |
| 7,267,578 | B2 * | 9/2007 | Wu | 439/607 |
| 7,275,940 | B2 * | 10/2007 | Chen | 439/79 |
| 7,275,941 | B1 * | 10/2007 | Bushby | 439/133 |
| 7,359,208 | B2 * | 4/2008 | Ni | 361/752 |
| 2005/0130498 | A1 * | 6/2005 | Fan | 439/630 |
| 2006/0040562 | A1 * | 2/2006 | Funatsu | 439/660 |
| 2006/0172599 | A1 * | 8/2006 | Hankey et al. | 439/607 |
| 2007/0010115 | A1 * | 1/2007 | Teicher | 439/173 |
| 2007/0049119 | A1 * | 3/2007 | Fujimoto et al. | 439/610 |
| 2007/0218762 | A1 * | 9/2007 | Liao et al. | 439/607 |

* cited by examiner

*Primary Examiner*—T C Patel
*Assistant Examiner*—Harshad C Patel
(74) *Attorney, Agent, or Firm*—Wei Te Chung

(57) ABSTRACT

A flash memory device includes a control board with a circuit board and a plug connecting with the circuit board, and a case enclosing the control board. The circuit board has two opposite surfaces. The plug includes an insulative housing and a number of contacts retained therein. The insulative housing has a tongue extending in a front to back direction. The contacts include a number of first contacts and a number of second contacts. Each first contact has a nonelastic contact portion and a tail portion arranged on the circuit board. Each second contact has an elastic contact portion located behind the nonelastic contact portion along the front to back direction and a tail portion arranged on the circuit board.

20 Claims, 6 Drawing Sheets

FLASH MEMORY DEVICE WITH IMPROVED CONTACT ARRANGEMENT

BACKGROUND OF THE INVENTION

1. Field of the Invention

The present invention relates to flash memory device, and more particularly to flash memory device with Universal Serials Bus (USB) plug.

2. Description of Related Art

A flash memory device, like a portable hard drive, is composed of a controllable and memorizable electronic circuit board for accessing data files. Universal serial bus (USB) is standard by the USB Implementers Forum (USB-IF), an industry standard body incorporating leading companies from the computer and electronic industries. USB is widely used to connect peripherals such as digital cameras, printers, external storage, networking components, etc. USB plug is assembled on the flash memory device for connecting with various peripherals. The USB plug connects with an end of the electronic circuit board and presents as a transfer interface between the electronic circuit board and a matrix (like a computer system). The flash memory device further comprises a case for protecting the electronic circuit board from dust and humidity. The USB plug extends out of an opening of an end of the case.

With rapid development of electronic industry, USB 2.0 was standardized by the USB-IF at the end of 2001. The speed rate of USB 2.0 is up to 480 Mbit/s (60 MB/s). Though Hi-Speed devices are commonly referred to as "USB 2.0" and advertised as "up to 480 Mbit/s", not all USB 2.0 devices are so Hi-Speed. Hi-Speed devices typically only operate at half of the full theoretical (60 MB/s) data throughput rate. However, under a circumstance transmitting an audio or video file, which is always up to hundreds MB, even to 1 or 2 GB. As a consequence, fast serial-bus interfaces are being introduced to address different requirements. PCI Express, at 2.5 GB/s, and SATA, at 1.5 GB/s and 3.0 GB/s, are two examples of High-Speed serial bus interfaces.

However, these non-USB protocols are not used as broadly as USB protocols. Many portable devices are equipped with USB interfaces other than these non-USB interfaces. One important reason is that these non-USB interfaces contain a greater number of signal pins than an existing USB interfaces and are physically larger as well. USB include four pins such as power, ground and serial differential data D+, D− pin. While the PCI Express is a 26-pin interface and wider card-like form factor limit the use of Express Card, the SATA uses two connectors, one 7-pin connector for signals and another 15-pin connector for power. The existing USB interfaces have a small size but low transmission rate, while other non-USB interfaces have a high transmission rate but large size. Neither of them is desirable to implement modem high-speed, miniaturized electronic devices and peripherals. To provide a flash memory device with a kind of plug which has a small size and a high transmission rate for portability and high data transmitting efficiency is much desirable.

Hence, a flash memory device with a kind of interface with a small size and a high transmission rate is needed to solve the problem above.

BRIEF SUMMARY OF THE INVENTION

According to one aspect of the present invention, a flash memory device includes a control board having a circuit board and a plug connecting with the circuit board, and a case enclosing the control board. The circuit board has two opposite surfaces. The plug comprises an insulative housing and a plurality of contacts retained therein. The insulative housing has a tongue extending in a front to back direction. The contacts comprise a group of first contacts and a group of second contacts for transferring high-speed signals. Each first contact comprises a nonelastic contact portion and a tail portion arranged on the circuit board. Each second contact comprises an elastic contact portion located behind the nonelastic contact portion along the front to back direction and a tail portion arranged on the circuit board.

According to another aspect of the present invention, a flash memory device comprises a control board having a circuit board and a plug connecting with the circuit board, and a case enclosing the control board. The circuit board has two opposite surfaces. The plug comprises a tongue extending along a front to back direction and a plurality of contacts retained thereon. The tongue defines a supporting surface. Each contact has a contact portion exposed on the supporting surface and a tail portion connecting with the circuit board. The contacts comprise a plurality of first contacts and a plurality of second contacts. The contact portions of the first contacts and the contact portions of the second contacts are arranged on the same side of the tongue and located at different height.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
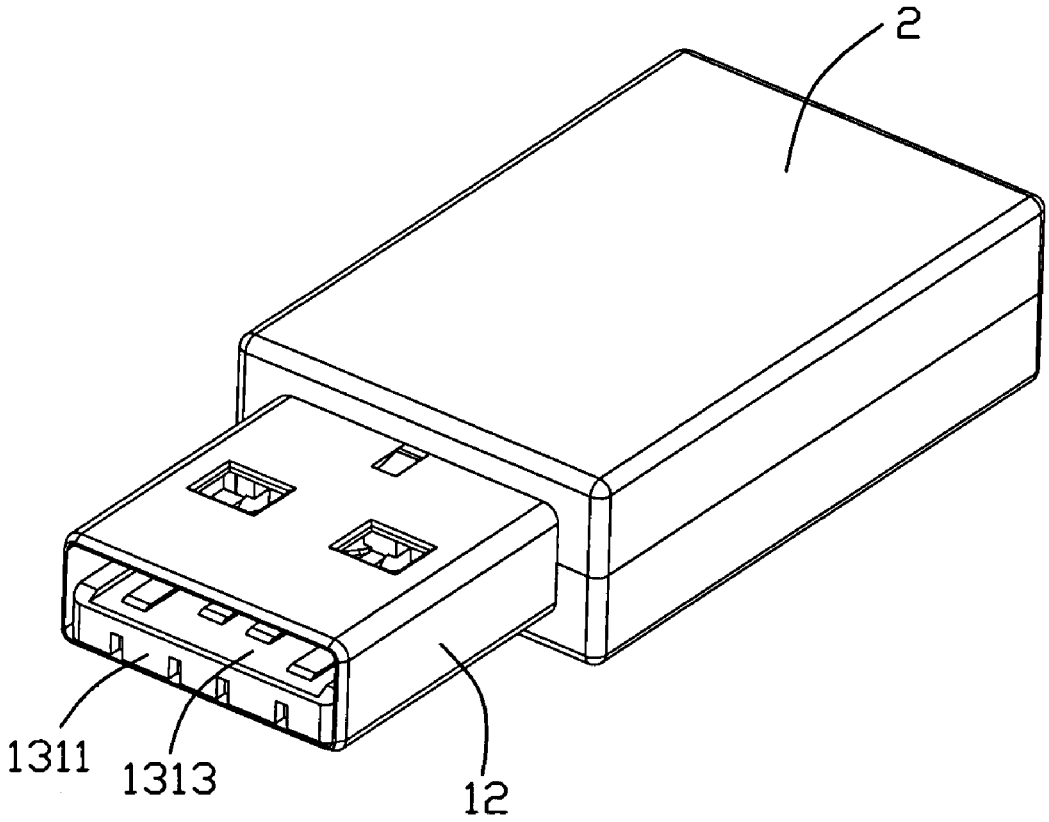
FIG. 1 is a perspective view of the preferred embodiment of a flash memory device according to the present invention.
Figure 2:
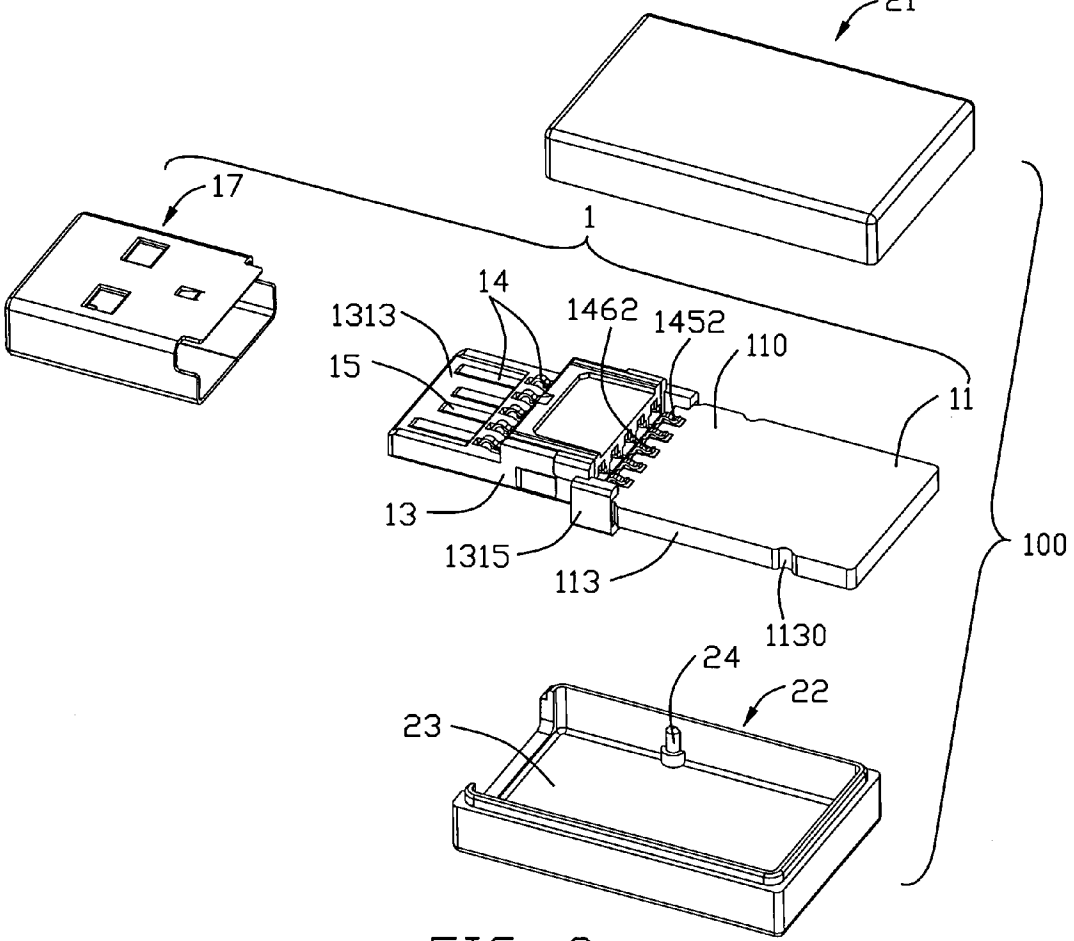
FIG. 2 is a partial exploded perspective view of the flash memory device shown in FIG. 1.
Figure 3:
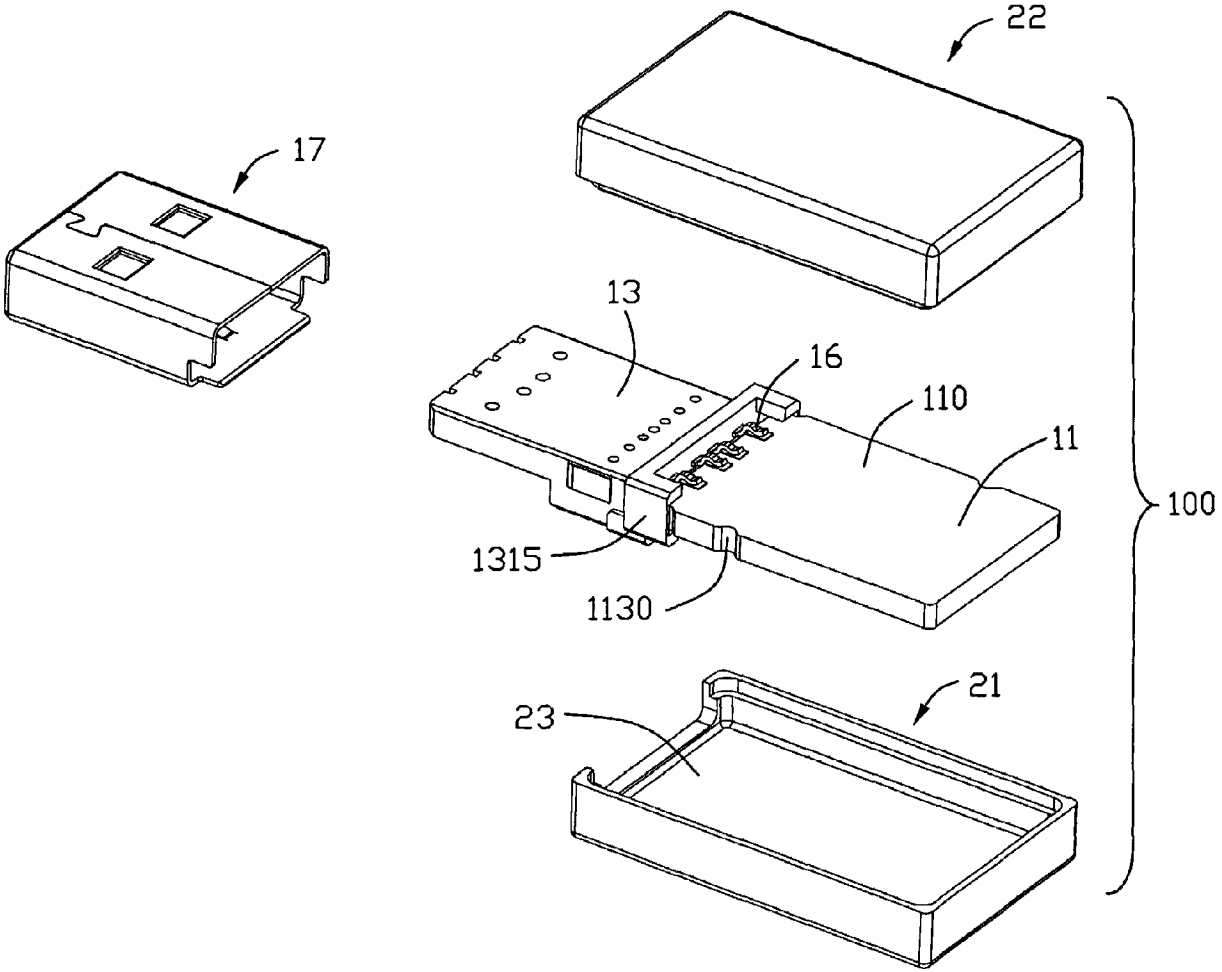
FIG. 3 is a view similar to FIG. 2, while taken from another aspect.
Figure 4:
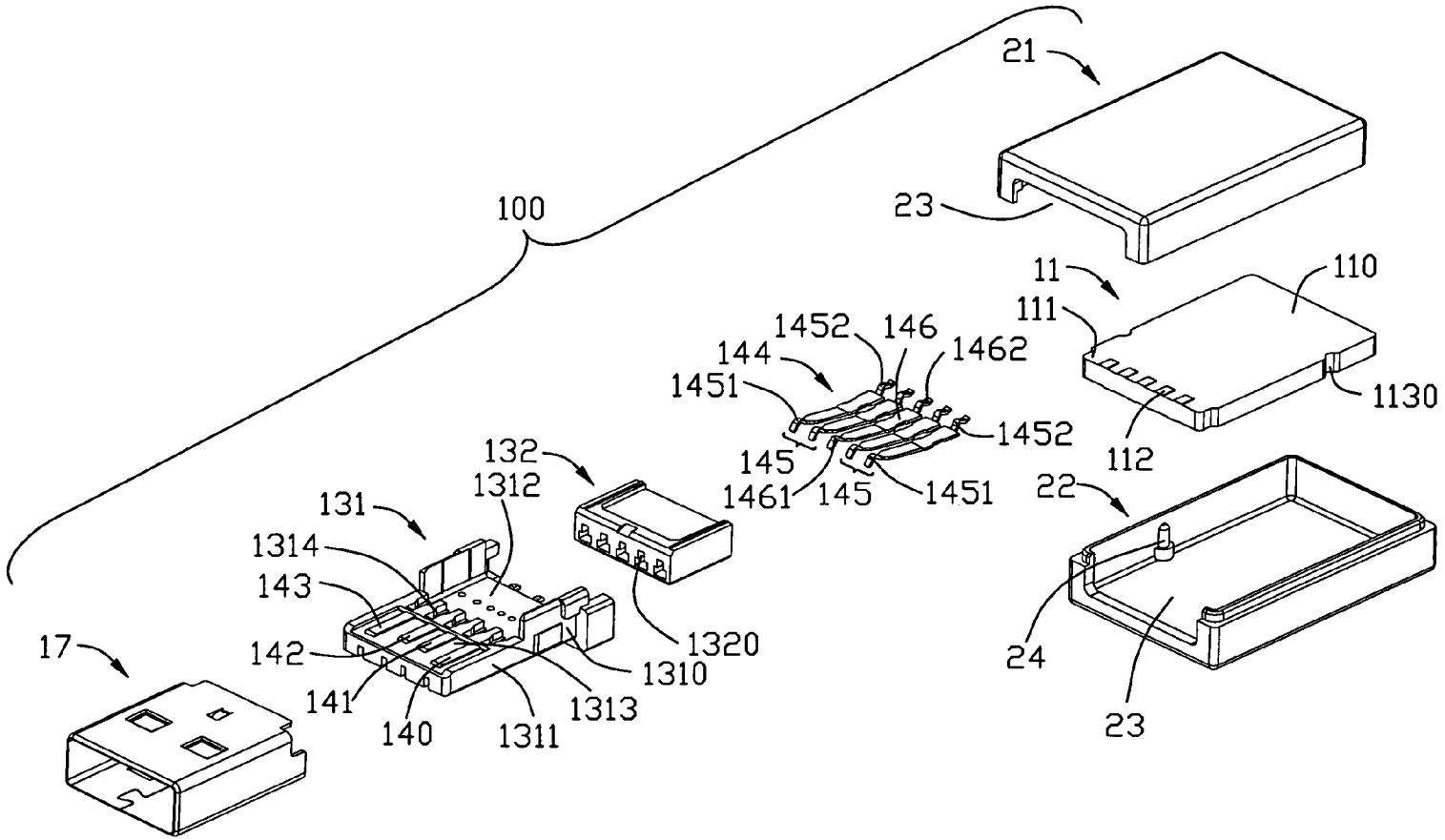
FIG. 4 is an exploded perspective view of the flash memory device shown in FIG. 1.
Figure 5:
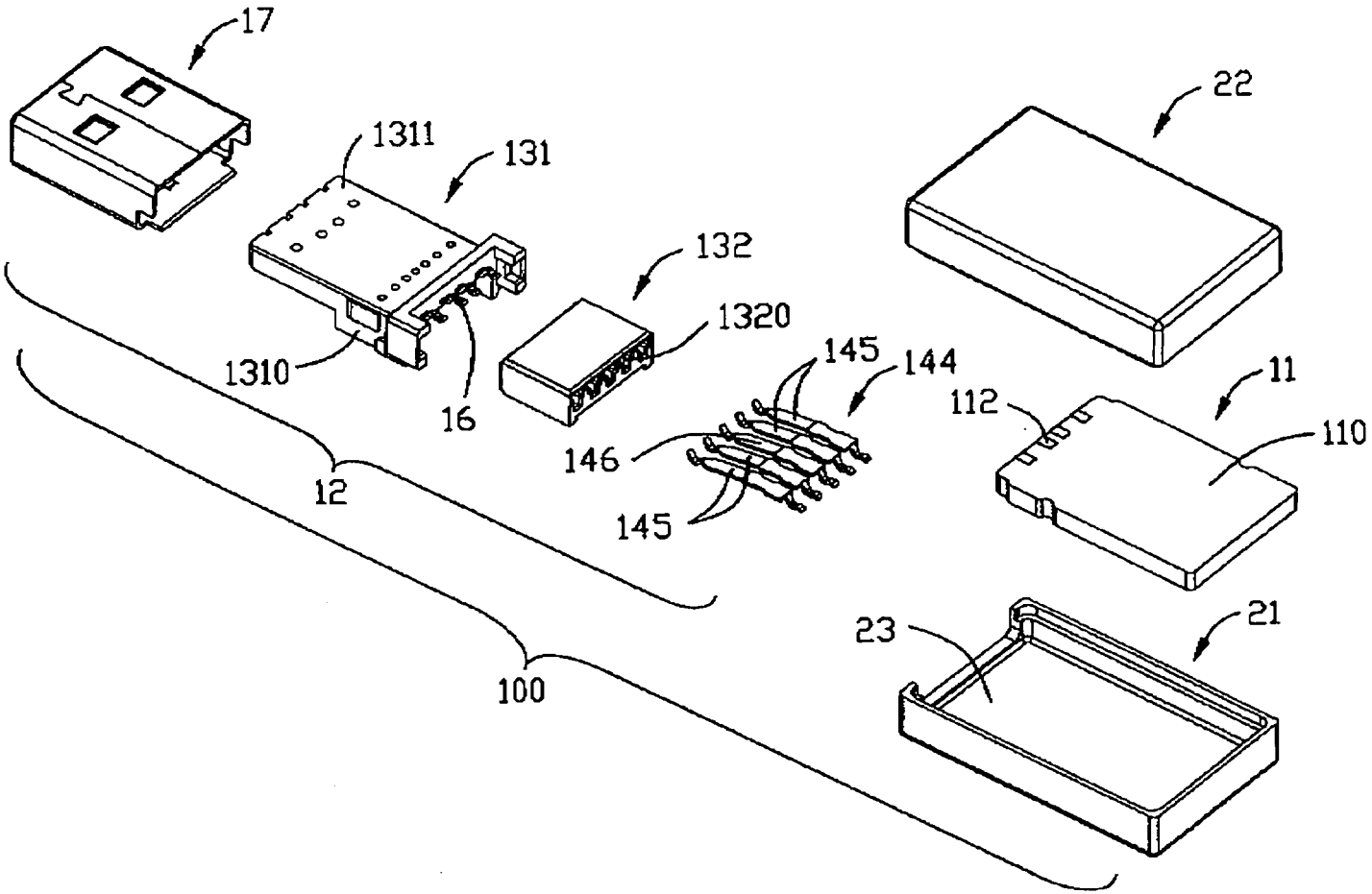
FIG. 5 is a view similar to FIG. 4, while taken from another aspect.
Figure 6:
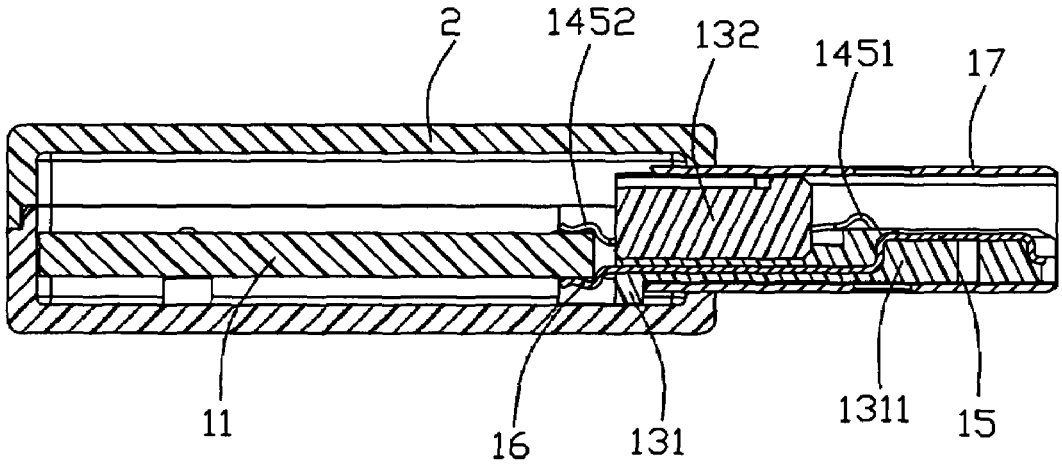
FIG. 6 is a cross-sectional view of the flash memory device.

Referring to FIGS. 1-6, a flash memory device 100 is disclosed in accordance with the present invention. The flash memory device 100 comprises a control board 1 and a case 2 enclosing the control board 1.

The control board 1 includes a circuit board 11 and a plug 12 connecting with the circuit board 11. The circuit board 11 has two opposite surfaces 110 and a plurality of electronic components (not shown), such as driver chip, memory chip, oscillator, resistor, etc. for saving and loading data, functioning as a miniature hard drive or wireless communication/transmission. The circuit board 11 has a coupling end 111 at a front edge thereof with a plurality of pins 112 retained thereon. The coupling end 111 is provided for connecting the plug 12. The circuit board 11 also has two side walls 113 with a notch 1130 formed thereon.

The plug 12 comprises an insulative housing 13, a plurality of contacts 14 retained therein and a metal shell 17 enclosing the insulative housing 13. The insulative housing 13 includes a first housing 131 and a second housing 132 coupled with each other. The first housing 131 has a base portion 1310 and a tongue 1311 extending from the base portion 1310 along a front to back direction. The base portion 1310 defines a receiving cavity 1312 for retaining the second housing 132. The tongue 1311 has a supporting surface 1313 and a plurality of slots 1314 on a rear end thereof. The base portion 1310 comprises a pair of side walls 1315 extending backwardly from a rear end thereof to fasten the circuit board 11 therebetween. The second housing 132 is received in the receiving cavity 1312 of the base portion 1310 and presents as a rectangular shape. A plurality of passageways 1320 extend through the second housing 132 along the front to back direction. The metal shell 17 is a hollow frame to hold the first housing 131 and the second housing 132 therein.

The contacts 14 comprise four first contacts designated with numeral 140, 141, 142, 143 and a plurality of second contacts 144. The first contacts 140, 141, 142, 143 are insert-molded to the first housing 131. The first contacts 140, 141, 142, 143 are substantially of the same configuration, and each comprises a nonelastic contact portion 15 exposed on the front end of the supporting surface 1313, and a tail portion 16 extending out of the first housing 131 for connecting with four pins 112 on a surface 110 of the circuit board 11. The contact portions 15 are juxtaposed with respect to each other along the front to back direction.

The second contacts 144 are retained in the passageways 1320 of the second housing 132 and include two pairs of differential contacts 145 and a grounding contact 146. The two pairs of differential contacts 145 are used for transferring high-speed signals. The grounding contact 146 is disposed between the two pairs of differential contacts 145 for preventing cross-talk. Each differential contact 145 of each pair comprises an elastic contact portion 1451 extending into the slots 1314 of the first housing 131 and a tail portion 1452 extending out of a rear end of the second housing 132. The differential contacts 145 and the grounding contact 146 are juxtaposed with respect to each other along the front to back direction. The grounding contact 146 comprises an elastic contact portion 1461 which is of the same configuration as the contact portion 1451, and a tail portion 1462 located between the tail portions 1452 of each pair. Each contact portion 1451, 1461 is cantileveredly received in the slots 1314 and protrudes upwardly beyond the supporting surface. 1313 so that the contact portions 1451, 1461 are elastic and deformable when engaging with corresponding contacts of a receptacle (not shown). The contact portions 1451, 1461 of the second contacts 144 and the contact portions 15 of the first contacts 140, 141, 142, 143 are arranged on the same side of the tongue 1311 but separated in the front to back direction with no portion of them contacting with each other, and located at different height along an upper to down direction. The contact portions 15 of the first contacts 140, 141, 142, 143 are arranged in a first row in a direction perpendicular to the front to back direction. The contact portions 1451, 1461 are arranged in a second row behind the first row. The tail portions 1452, 1462 connect with the pins 112 on the surface 110 of the circuit board 11.

The plug 12 is an extension to existing standard USB 2.0 plug and is compatible to existing standard USB 2.0 receptacle. The geometric profile of the tongue 1311 is same to what of the standard USB 2.0 plug with an allowable tolerance. That is, length, width and height of the tongue 1311 are substantially equal to what of the standard USB 2.0 plug. An arrangement of the first contacts 140, 141, 142, 143 is compatible to what of the standard USB 2.0 receptacle. The first contacts 140, 141, 142, 143 are for USB 2.0 protocol to transmit USB 2.0 signals. In detail, the first contacts 140, 141, 142, 143 are for power signal, – data signal, + data signal and ground signal, respectively. So now, from assignment of each contact portions standpoint, different terminology are given to each of the first contacts, 140, 141, 142, 143, wherein the first contacts 140, 141, 142, 143 are respectively named as power contact 140, – data contact 141, + data contact 142 and ground contact 143.

The case 2 comprises an upper case 21 and a lower case 22 coupled with each other. A receiving space 23 is formed between the upper case 21 and the lower case 22 for receiving the control board 1 therein. Each upper case 21 and lower case 22 has a projection 24. The projections 24 engage with the notches 1130 of the side walls 113 for preventing the circuit board 11 from moving.

With contrast to a normal flash memory device with a standard USB 2.0 plug, the additional two pairs of differential contacts 145 in the flash memory device 100 of the present invention provide a high transfer data for an electrical receptacle system with the flash memory device 100 of the present invention in operation. Take the plug 12 of the flash memory device 100 for example, the arrangement of the power contact 140, the – data contact 141, the + data contact 142 and the ground contact 143 is compatible to what of a standard USB 2.0 receptacle. This means that the flash memory device 100 in the present invention can be applied in any field that the standard USB 2.0 plug is applied. The pair of differential contacts 145 are located behind the first contacts 140, 141, 142, 143. With such arrangement, the flash memory device 100 is with an ease structure and is portable. Furthermore, as the two pairs of the differential contacts 145 are used for a non-USB 2.0 protocol, now, the flash memory device also can be applied in other electronic device supporting the non-USB 2.0 protocol.

In addition, the plug 12 is straddle mounted to the circuit board 11 with the tail portions 16 of the first contacts 140, 141, 142, 143 and the tail portions 1452, 1462 of the second contacts 144 soldered on the opposite surfaces 110 of the circuit board 11 respectively, which not only reduce cross-talk between the first and second contacts, but also reduce the height of flash memory device 100.

In the present invention, the number of the second contacts 144 is five which comprise two pairs of differential contacts 145 and a grounding contact 146 disposed between two pair of the differential contacts 145. However, in other embodiment, the second contacts 144 can comprise only a pair of differential contacts or more than two pairs of differential contacts for transmitting high-speed signals, and if necessarily, a grounding contact or more than one grounding contact can be provided to be positioned between each two pairs of the differential contacts.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A flash memory device, comprising:

a control board having a circuit board and a plug connecting with the circuit board, the circuit board having two opposite surfaces; and a case enclosing the circuit board;

wherein the plug comprises an insulative housing and a plurality of contacts retained therein, the insulative housing having a tongue extending along a front to back direction;

wherein the contacts comprise a group of first contacts insert-molded in the insulative housing and a group of second contacts, each first contact comprising a nonelastic contact portion and a tail portion arranged on the circuit board, each second contact comprising an elastic contact portion located behind the nonelastic contact portion along the front to back direction and a tail portion arranged on the circuit board.

2. The flash memory device according to claim 1, wherein the tail portions of the first contacts and the tail portions of the second contacts are soldered on the opposite surfaces of the circuit board respectively.

3. The flash memory device according to claim 1, wherein the first contacts comprise a power contact, a – contact, a + contact and a ground contact, and wherein the second contacts comprise at least a pair of differential contacts.

4. The flash memory device according to claim 3, wherein the first contacts are adapted to USB 2.0 A type protocol and compatible to a standard USB 2.0 A type receptacle.

5. The flash memory device according to claim 1, wherein the geometric profile of the tongue is substantially same as that of a standard USB 2.0 A type plug.

6. The flash memory device according to claim 1, wherein the tongue defines a supporting surface, the nonelastic contact portions and the elastic contact portions being held in the supporting surface, and wherein the elastic contact portions of the second contacts are juxtaposed along the front to back direction.

7. The flash memory device according to claim 1, wherein the insulative housing comprises a first housing and a second housing coupled with each other, wherein the tongue is integrally extended from the first housing.

8. The flash memory device according to claim 7, wherein the first contacts are held in the first housing, the second housing defines a plurality of passageways extending therethrough for fastening the second contacts, and the tongue defining a plurality of slots located behind the nonelastic contact portions to receive the elastic contact portions.

9. A flash memory device for mating with a corresponding receptacle connector, comprising:

a control board having a circuit board and a plug connecting with the circuit board, the circuit board having two opposite surfaces; and a case enclosing the circuit board;

wherein the plug comprises a tongue extending along a front to back direction, a plurality of contacts retained thereo and a metal shield, the tongue defining a supporting surface formed on an upper portion thereof, the metal shield having an upper wall, a mating cavity being formed between the supporting surface and the upper wall for receiving a corresponding receptacle connector each contact having a contact portion disposed above the supporting surface and exposed to the mating cavity, and a tail portion connecting with the circuit board;

wherein the contacts comprise a plurality of first contacts and a plurality of second contacts, the contact portions of the first contacts and the contact portions of the second contacts arranged at the same side of the supporting surface and located at different height.

10. The flash memory device according to claim 9, wherein the tail portions of the first contacts and the tail portions of the second contacts are located at the opposite surfaces respectively to set the circuit board therebetween, and located at a same position in the front to back direction.

11. The flash memory device according to claim 9, wherein the first contacts are adapted to USB 2.0 A type protocol and compatible to a standard USB 2.0 A type receptacle.

12. The flash memory device according to claim 9, wherein the geometric profile of the tongue is substantially same as that of a standard USB 2.0 A type plug.

13. The flash memory device according to claim 9, wherein the contact portions of the first contacts are nonelastic, and the contact portions of the second contacts are elastic, wherein the nonelastic contact portions arc arranged in a first row in a direction perpendicular to the front to back direction, and the elastic contact portions of the second contacts arranged in a second row behind the first row.

14. The flash memory device according to claim 9, wherein the tongue has a lower surface opposite to the supporting surface and a pair of opposite side surfaces, and the metal shield has a lower wall opposite to the upper wall and a pair of side walls connecting the upper and lower walls, wherein the lower surface and the side surfaces are affixed to corresponding lower wall and side walls respectively.

15. The flash memory device according to claim 14, wherein each upper and lower wall defines a pair of locking holes.

16. The flash memory device according to claim 9, wherein the first contacts are insert-molded in the tongue while the second contacts are inserted into corresponding slots of the tongue.

17. The flash memory device according to claim 9, wherein the circuit board has a pair of side walls, and each side wall defines a notch, the case has a pair of projections engaging with the notch for preventing the circuit board from moving.

18. An electronic device comprising:

an electrical connector unit including an insulative housing subassembly carrying first and second type contacts therein; each of said first type contacts defining a first mating section and a first mounting section opposite to each other in a front-to-back direction, each of said second type contacts defining a second mating section and a second mount section opposite to each other in said front-to-back direction;

a metallic shell enclosing said housing sub-assembly and cooperating with the housing sub-assembly to define a mating cavity;

a casing assembled on a rear side of the connector unit and defining a receiving cavity; and a printed circuit board received within said receiving cavity; wherein the first mating sections and the second mating setions are exposed in the mating cavity in an offset mariner in both front-to-back direction and a vertical direction perpendicular to said front-to-back direction, wherein the first mounting sections and the second mating sections are respectively mounted on two opposite surfaces of the printed circuit board, wherein the second mating sections and the second mounting sections are essentially located at a similar level while the first mating sections and the first mounting sections are not.

19. The electronic device as claimed in claim 18, wherein said housing subassembly includes a first housing unit carrying the first type contacts and a second housing unit carrying the second type contacts and stacked upon the first housing unit.

20. The electronic device as claimed in claim 19, wherein the first contacts are integrally insert-molded in the first housing while the second contacts are inserted into corresponding passageways in the second housing.

* * * * *